US005246400A

United States Patent [19]

Klucik

[11] Patent Number: 5,246,400

[45] Date of Patent: Sep. 21, 1993

[54] PORTABLE RIDER-PROPELLED ROUNDABOUT

[76] Inventor: Rudolf Klucik, 12285 W. 7th Dr., Golden, Colo. 80401

[21] Appl. No.: 914,431

[22] Filed: Jul. 15, 1992

[51] Int. Cl.[5] ..... A63G 1/10

[52] U.S. Cl. ..... 472/21; 472/26

[58] Field of Search ..... 472/21, 26; 104/45, 104/17.1, 62; 280/259, 260, 262

[56] References Cited

U.S. PATENT DOCUMENTS

| | | | |
|---|---|---|---|
| 589,408 | 9/1897 | Brannan . | |
| 605,629 | 6/1898 | Brannan . | |
| 832,459 | 10/1906 | Cruz . | |
| 885,406 | 4/1908 | Vance . | |
| 1,660,012 | 2/1928 | Moore et al. . | |
| 1,881,646 | 10/1932 | Jones | 472/21 |
| 2,515,499 | 7/1950 | Drucker | 472/21 |
| 2,533,368 | 12/1950 | Hansen et al. | 272/33 |
| 2,621,929 | 12/1952 | Jackson | 272/44 |
| 2,638,345 | 5/1953 | Norvell | 272/33 |
| 2,839,296 | 6/1958 | Paul | 272/31 |
| 3,672,669 | 6/1972 | Ottaviano | 272/338 |

OTHER PUBLICATIONS

Frederick Fried, "A Pictorial History of the Carousel", 1964, 4 pages.

*Primary Examiner*—Carl D. Friedman

*Assistant Examiner*—Kien Nguyen

*Attorney, Agent, or Firm*—John R. Flanagan

[57] ABSTRACT

A portable rider-propelled roundabout includes a platform having a circular track formed by a pair of semicircular halves, a plurality of pedal-propelled riding cycles, and a revolving mechanism operable for supporting the riding cycles upright on the circular track for undergoing revolving movement therealong about a center point defined by the circular track. The platform also including reinforcing frameworks extending between and rigidly connected with spaced portions of the respective track halves and pivotal hinges connecting the track halves together for pivotal movement about a longitudinal axis so as to permit converting the platform between a transport condition in which the track halves are disposed in a side-by-side folded relation to one another and a deployed condition in which said track halves are disposed in an unfolded coplanar relation with one another. The revolving mechanism includes a lower member removably supportable in a stationary relation on the platform frameworks, an upper member mountable on the lower member in a rotatable relation about the center point of the track, and a plurality of members extending between and interconnecting the upper portion and the riding devices for supporting the riding cycles upright on the platform track for undergoing movement along the track and about the center point of the track.

20 Claims, 2 Drawing Sheets

FIG. 1
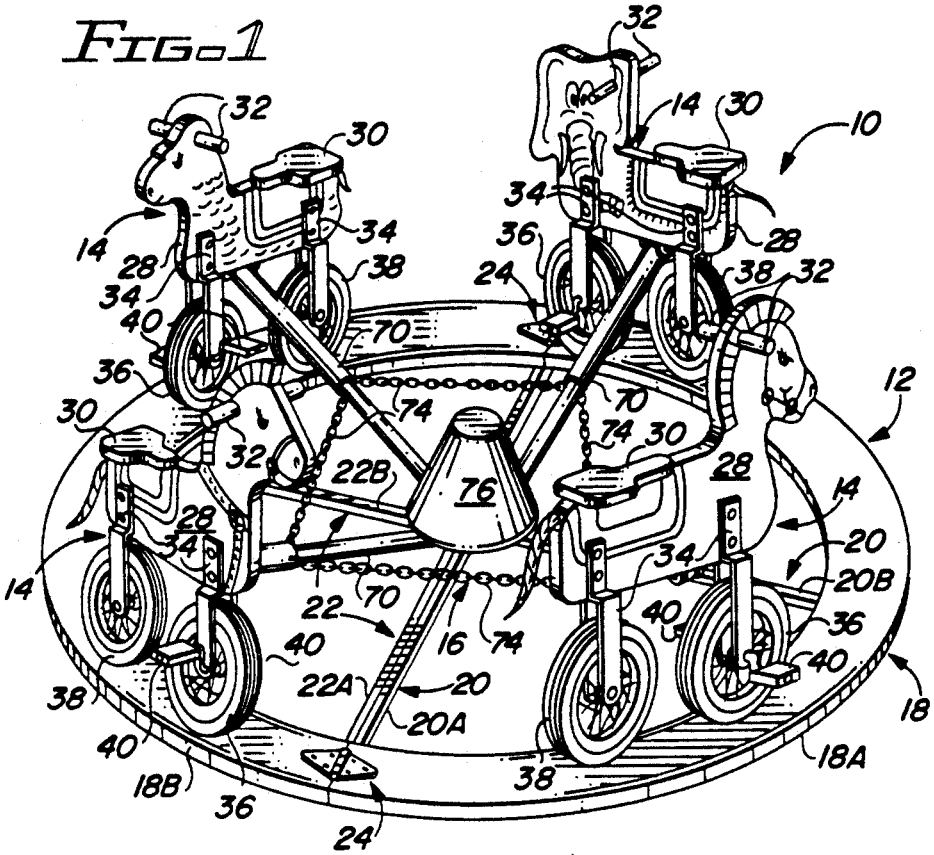
FIG. 2
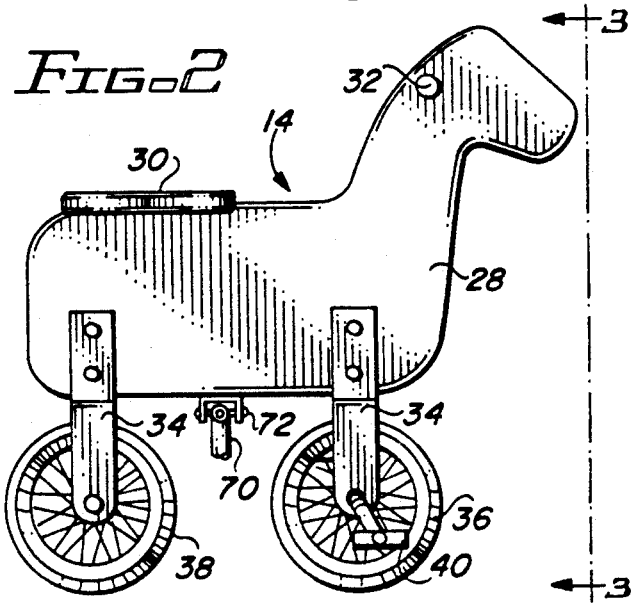
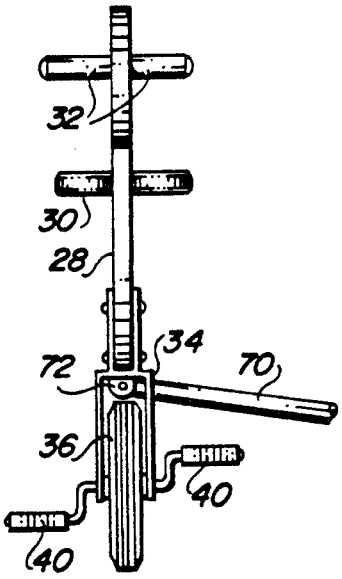
FIG. 3
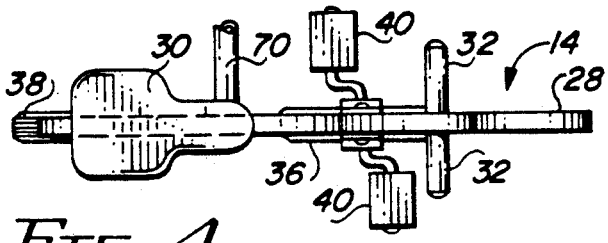
FIG. 4

FIG. 5
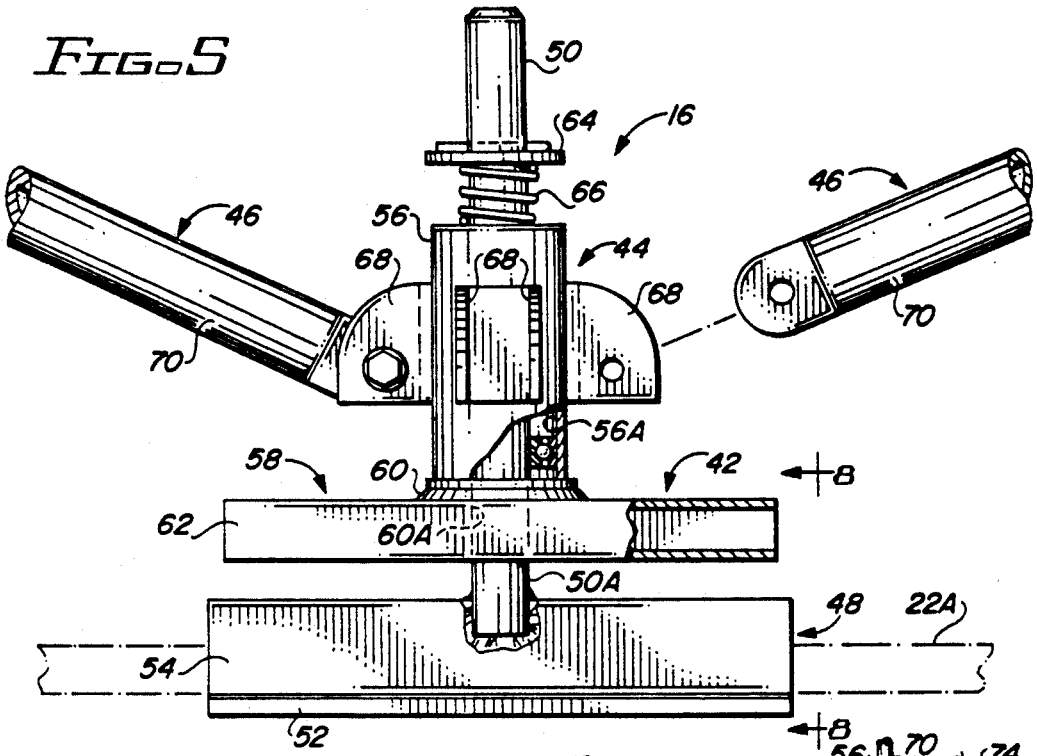
FIG. 6
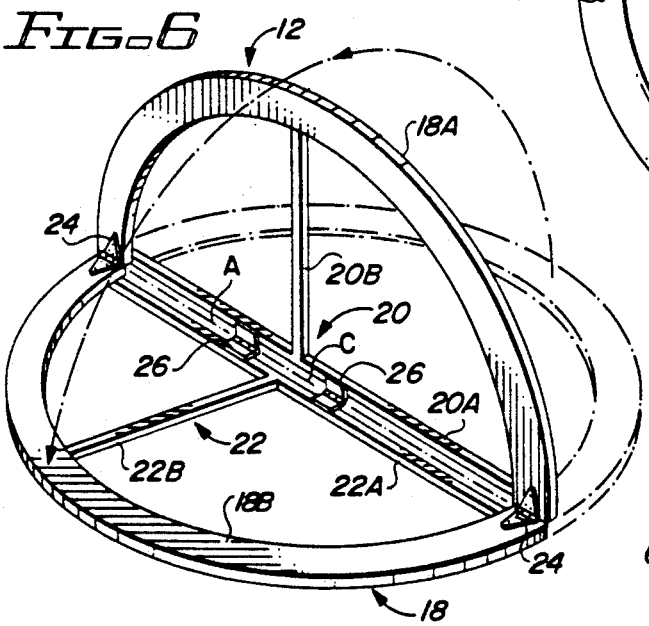
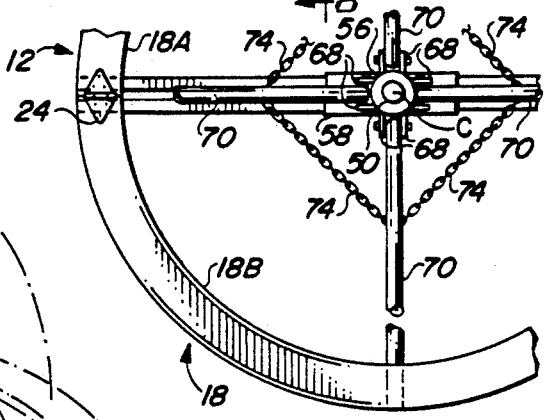
FIG. 7
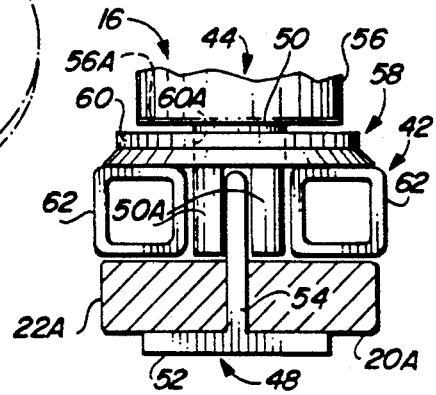
FIG. 8

PORTABLE RIDER-PROPELLED ROUNDABOUT

BACKGROUND OF THE INVENTION

1. Field of the Invention

The present invention generally relates to recreational equipment and, more particularly, is concerned with a portable rider-propelled roundabout for facilitating the playful exercise of children.

2. Description of the Prior Art

Roundabouts, also known as merry-go-rounds, are types of recreational equipment that provide amusement rides enjoyed by small children. Roundabouts which employ pedal power have been proposed in the prior patent art. Such roundabouts are fun for children and also provide vigorous exercise for them as well as teach them the benefits of working together.

U.S. Pat. No. 2,638,345 to Norvell discloses a rider propelled roundabout having a central support standard mounting a rotatable plate which, in turn, has a pair of radial arms and hobby horses attached to the outer ends of the arms. The hobby horses are mounted on a wheel having pedals and running on a circular track. The wheeled hobby horse is propelled by the rider turning the pedals.

U.S. Pat. No. 3,672,669 to Ottaviano discloses a roundabout which can be driven either by pedal power of the rider or by an electric motor. The roundabout includes a stand that supports a rotatable frame having radial arms whose outer ends are attached to riding units. The riding units have horse-shaped bodies supported upon front and rear wheels that travel on the ground. The electric motor is mounted on the stand below the arms and has a gear which is engageable with a gear mounted on the underside of the rotatable frame.

While these prior art roundabouts appear to be a step in the right direction, they still appear to embody certain drawbacks. The roundabouts occupy too much space and are constructed to be outdoor permanent installations. Thus, the roundabouts cannot be taken apart easily for storage nor transported easily in a vehicle for different purposes, such as for taking on vacation trips or to someplace for use as a recreational attraction at a child's party. Also, the prior art roundabouts are not designed for use indoors.

Consequently, a need still exists for a roundabout having an improved construction which will overcome these drawbacks of the prior art.

SUMMARY OF THE INVENTION

The present invention provides a portable roundabout designed to satisfy the aforementioned need. The portable roundabout of the present invention can be easily assembled, operated and disassembled. Also, the portable roundabout is lightweight and compact and takes up minimal space. Further, it can easily be transported by car, airplane or train. Finally, the roundabout can be used either indoors or outdoors.

Accordingly, the present invention is directed to a portable roundabout which comprises: (a) a platform including a generally circular track defining a center point and being defined by a pair of generally semi-circular halves; (b) a plurality of riding devices; and (c) a revolving mechanism for supporting the riding devices upright on the circular track and for undergoing revolving movement therealong about the center point of the circular track.

Also, the platform of the roundabout includes a pair of reinforcing frameworks each extending between and rigidly connected with spaced portions of one of the track halves and means for connecting the track halves to one another and the frameworks to one another so as to permit converting of the platform between a transport condition in which the track halves can be disposed in a side-by-side relation to one another and a deployed condition in which the track halves are disposed in a coplanar relation with one another.

The reinforcing frameworks of the platform include a pair of elongated bars extending parallel to each other and being spaced apart and a pair of elongated brace. Each bar extends between and is rigidly connected at opposite ends to the opposite ends of one of the track halves. Each elongated brace extends between and is rigidly connected at opposite ends to a center of one of the bars and a center of one of the track halves.

The means for connecting the track halves to one another and the frameworks to one another are outer and inner pairs of spaced pivotal hinges. The outer pair of pivotal hinges are attached to and span between adjacent ones of the opposite ends of the track halves so as to pivotally connect the track halves together for pivotal movement about a longitudinal axis defined by the outer pair of hinges. The inner pair of pivotal hinges are attached to and span between the frameworks so as to pivotally connect the frameworks together for pivotal movement about the longitudinal axis defined by the outer pair of hinges. The hinges of the inner pair are spaced apart from one another on opposite sides of the center point of the track.

Each riding device of the roundabout includes a flat vertical plate depicting an object or figure of a character, a seat and a pair of handles mounted on the plate, and a pair of brackets attached to and extending below the plate. Each riding device also includes a pair of front and rear wheels mounted to lower ends of the respective brackets and arranged in spaced apart tandem relation to each other and aligned along an circular path corresponding to the circular track. A pair of pedals are attached to and project from opposite sides of the front wheel.

The revolving mechanism of the roundabout includes a lower member mountable in a stationary relation on the frameworks of the platform and in symmetrical relation about the center point of the track when the platform is in the deployed condition. The revolving mechanism also includes an upper member mountable on the lower member in a rotatable relation therewith about the center point of the track and a plurality of elongated members extending between and interconnecting the upper member and the riding devices for supporting the riding devices upright on the track of the platform for revolving movement therealong about the center point of the track. The upper member of the revolving mechanism includes a locking structure which can be moved toward and away from the lower member between an upper releasing position wherein the lower member can be installed and removed from between and below the frameworks and a lower locking position wherein the lower and upper members can be respectively disposed in a clamping relation above and below the adjacent portions of the frameworks with the track halves disposed in the coplanar relation and the platform in the deployed condition.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective view of a portable rider-propelled roundabout of the present invention being shown with its platform in an unfolded, deployed condition.

FIG. 2 is a side elevational view of one of the riding devices of the roundabout.

FIG. 3 is a front end elevational view of the riding device as seen along line 3—3 of FIG. 2.

FIG. 4 is a top plan view of the riding device of FIG. 2.

FIG. 5 is an enlarged fragmentary view of a revolving mechanism of the roundabout of FIG. 1, showing upper and lower members of the revolving mechanism in an upper releasing position.

FIG. 6 is a perspective view of the platform of the roundabout of FIG. 1 by itself.

FIG. 7 is a fragmentary top plan view of the roundable of FIG. 1 with the riding devices omitted.

FIG. 8 is a fragmentary end view of the revolving mechanism as seen along line 8—8 of FIG. 5, but showing the upper and lower members of the revolving mechanism in a lower locking position.

DETAILED DESCRIPTION OF THE INVENTION

Referring to the drawings, and particularly to FIGS. 1, 6 and 7, there is illustrated a portable roundabout, generally designated 10, constructed in accordance with the principles of the present invention. The portable roundabout 10 basically includes a circular platform 12, a plurality of riding devices 14, and a revolving mechanism 16. The platform 12 includes a generally circular track 18 defining a center point C and being formed of a pair of substantially identical semi-circular halves 18A, 18B. The revolving mechanism 16 is operable for supporting the riding devices 14 upright on the circular track 18 for undergoing revolving movement therealong about the center point C of the circular track.

Also, the circular platform 12 of the roundabout 10 includes a pair of reinforcing frameworks 20, 22. Each framework 20, 22 reinforces one of the track halves 18A, 18B by extending between and rigidly connecting with spaced portions of the respective one track half 18A, 18B. The reinforcing frameworks 20, 22 of the platform 12 respectively include elongated rigid bars 20A, 22A and braces 20B, 22B. Each elongated bar 20A, 22A extends between and is rigidly connected at its opposite ends to the opposite ends of one of the track halves 18A, 18B such that the bars 20A extend generally parallel to one another and are spaced apart from one another. Each elongated brace 20B, 22B extends between and is rigidly connected at its opposite ends to approximately the center of one of the bars 20A, 22A and the center of one of the track halves 18A, 18B. In such arrangement, the track halves 18A, 18B and reinforcing frameworks 20, 22 provide rigid planar platform halves.

The circular platform 12 further includes means in the form of outer and inner pairs of pivotal hinges 24, 26 for respectively connecting the track halves 18A, 18B to one another and the reinforcing frameworks 20, 22 to one another. The outer pair of spaced pivotal hinges 24 are attached to and span between adjacent ones of opposite ends of the track halves 18A, **18*b* so as to pivotally connect the track halves together for pivotal movement about a longitudinal axis A (FIG. 6) defined by the outer pair of hinges 24. The inner pair of spaced pivotal hinges 26 are attached to and span between the frameworks 20, 22 so as to pivotally connect the frameworks together for pivotal movement about the longitudinal axis A defined by the outer pair of hinges 24. The pivotal hinges 26 of the inner pair are spaced apart from one another on opposite sides of the center point C of the track 18**.

With such arrangement of the parts of the platform 12, the outer and inner hinges 24, 26 are operable to permit converting the platform 12 between a transport condition and a deployed condition which is shown in FIGS. 1 and 7. In the transport condition, the track halves 18A, 18B can be just disconnected from one another such as by disassembling the connected halves of the hinges 24, 26 from one another or preferably can be pivoted relative to one another into a side-by-side folded relation. In FIG. 6, the one track half 18A is illustrated in the process of being pivotally moved relative to the other track half 18B to the side-by-side folded relation of the track 18 and transport condition of the platform 12, from the deployed condition of the platform 12 in which the track halves 18A, 18B are disposed in a coplanar relation with one another.

Referring to FIGS. 1–4, each riding device 14 of the roundabout 10 is a riding cycle 14 having a flat vertical plate 28 depicting an object or figure of a character, such as an animal. Each riding cycle 14 also includes a seat 30 and a pair of handles 32 mounted on the plate 28, and a pair of forked brackets 34 attached to and extending below the plate 28. Each riding cycle 14 further includes a pair of front and rear spoked wheels 36, 38 rotatably mounted between the forked lower ends of the respective brackets 34 and arranged in spaced tandem relation to each other and aligned along an circular path concentric with the circular track 18. A pair of pedals 40 are attached to and project from opposite sides of the front wheel 36 of each riding cycle 14. Preferably, the riding cycles 14 are sized to accommodate children 3 to 6 years of age.

Referring to FIGS. 5–8, the revolving mechanism 16 of the roundabout 10 includes a lower member 42 mountable in a stationary relation on the frameworks 20, 22 of the platform 12 and symmetrically with the center point C of the circular track 18 when the platform 12 is in the deployed condition, and an upper member 44 mountable on the lower member 44 in a rotatable relation therewith about the center point C of the circular track 18. The plurality of elongated members 46 extend between and interconnect the upper member 44 and the riding cycles 14 for supporting the riding cycles 14 upright on the circular track 18 of the platform 12 for undergoing revolving movement therealong about the center point of the track 18.

The lower member 42 of the revolving mechanism 16 includes an elongated lower runner 48 and an elongated cylindrical vertical shaft 50. The lower runner 48 is disposable below adjacent portions of the reinforcing frameworks 20, 22 with the track halves 18A, 18B in the coplanar relation and the platform 12 in the deployed condition. The vertical shaft 50 is rigidly attached to and extending upwardly from the lower runner 42 above the frameworks 20, 22 and aligned with the center point C of the circular track 18. The lower runner 48 includes an elongated flat narrow bottom plate 52 disposable below the reinforcing frameworks 20, 22 and an upright flat plate 54 fixed along a longitudinal centerline of and extending upwardly from the bottom plate 52 and between the frameworks 20, 22. The bottom plate 52 and upright plate 54 provide the lower runner 48 with a cross-sectional T-shape. The bottom end 50A of the vertical shaft 50 is slotted so that it can be fitted over the center of the upright flat plate 54 where it is rigidly attached to the upright flat plate 54, such as by welding, so as to extend upwardly from the upright flat plate 54 of the lower runner 48.

The upper member 44 of the revolving mechanism 16 includes a cylindrical coupler 56 and an elongated lock structure 58. The coupler 56 has a central bore 56A for slidably fitting over the vertical shaft 50 of the lower member 42 of the revolving mechanism 16 such that the coupler is not only slidable vertically along the vertical shaft 50 but is also rotatable on the vertical shaft 50. The elongated lock structure 58 includes a plate 60 having a central opening 60A for installing the plate 60 over the vertical shaft 50 in a horizontal plane below the coupler 56 and a pair of tube sections 62 rigidly attached to the underside of the plate 60 so as to extend transversely to the vertical shaft 50. The lock structure 58 is movable vertically along the vertical shaft 50 away from the lower runner 48 to an upper releasing position, as seen in FIG. 5, wherein the runner 48 can be installed and removed from between and below the elongated bars 20A, 22A of the frameworks 20, 22 once the platform 12 is only partially unfolded between its folded and deployed conditions, as seen in FIG. 6. The lock structure 58 is also movable vertically along the vertical shaft 50 toward a lower locking position, as seen in FIG. 8, wherein the tube sections 62 of the lock structure 58 and the bottom plate 52 of the lower runner 48 respectively overlie and underlie and thus are disposed in a clamping relation above and below the adjacent portions of the elongated bars 20A, 22A of the frameworks 20, 22 with the upright plate 54 extending vertically between the bars 20A, 22A and the track halves 18A, 18B disposed in the coplanar relation and the platform 12 disposed in the deployed condition.

The upper member 44 also includes a collar 64 attached on the vertical shaft 50 and spaced above the slidable coupler 56, and a coil spring 66 disposed about the vertical shaft 50 between the collar 64 and the coupler 56 for biasing the coupler 56 and lock structure 58 therewith toward the lower locking position for retaining the track halves 18A, 18B in the unfolded coplanar relation and the platform 12 at the deployed position.

The rotatable and slidable coupler 56 of the upper member 44 also includes a plurality of pairs of spaced ears 68 being circumferentially spaced approximately ninety degrees from one another and attached about the coupler 56. The ears 68 project outwardly from the coupler 56. The elongated members 46 of the revolving mechanism 16 include a plurality of elongated arms 70. Each arm 70 extends between and is connected at opposite ends with one of the pairs of ears 68 on the coupler 56 and one of the riding cycles 14. The elongated members 46 also include a plurality of connector elements 72. Each connector element 72 is attached on one of the riding cycles 14 and receives and is connected with one of the opposite ends of the elongated arms 70. As seen in FIG. 1, the elongated members 46 also include a plurality of flexible link chains 74 for interconnecting adjacent ones of the arms 70 to one another. A conical cover 76 is applied over the revolving mechanism 16 to shield its relative moving parts. The coupler 56 rotates on the vertical shaft 50 as the riding cycles 14 are moved around the circular track 18 and the elongated arms 70 and link chains 74 revolve about the center point C.

The present invention can be understood from the foregoinq description and various changes may be made thereto without departing from its spirit and scope, the form hereinbefore described being merely preferred or exemplary embodiment of the present invention.

I claim:

1. A portable rider-propelled roundabout, comprising:

(a) a platform including a generally circular track defining a central point and being defined by a pair of generally semi-circular halves, said platform also including a pair of reinforcing frameworks each extending between and rigidly connected with spaced portions of one of said track halves, and means for connecting together either said track halves or said frameworks so as to permit converting of said platform between a transport condition in which said track halves can be disposed in a side-by-side relation to one another and a deployed condition in which said track halves are disposed in a coplanar relation with one another;

(b) a plurality of pedal-propelled riding cycles; and (c) a revolving mechanism for supporting said riding cycles upright on said circular track for revolving movement therealong about said center point of said circular track, said revolving mechanism including a lower portion mountable in a stationary relation on said frameworks of said platform when said platform is in said deployed condition, an upper portion mountable on said lower portion in a rotatable relation about said center point of said track, and a plurality of members extending between and interconnecting said upper portion and said riding cycles for supporting said riding cycles upright on said track of said platform for said revolving movement therealong about said center point of said track.

2. The roundabout of claim 1 wherein said means for connecting either said track halves or said frameworks is an inner pair of pivotal hinges spaced apart from one another and being attached to and spanning between said frameworks so as to pivotally connect said track halves together via said framewords for pivotal movement about a longitudinal axis defined by said inner pair of hinges.

3. The roundabout of claim 1 wherein said means for connecting either said track halves or said frameworks is an outer pair of pivotal hinges spaced apart from one another and being attached to and spanning between adjacent ones of opposite ends of said track halves so as to pivotally connect said track halves together for pivotal movement about a longitudinal axis defined by said outer pair of hinges.

4. The roundabout of claim 3 wherein said means for connecting either said track halves or said frameworks is an inner pair of pivotal hinges spaced apart from one another and being attached to and spanning between said frameworks so as to pivotally connect said frameworks together for pivotal movement about said longitudinal axis defined by said outer pair of hinges.

5. The roundabout of claim 1 wherein said reinforcing frameworks include:

a pair of elongated bars extending parallel to each other and being spaced apart, each bar extending between and rigidly connected at its opposite ends to opposite ends of one of said track halves;

a pair of elongated braces each extending between and rigidly connected at opposite ends to a center of one of said bars and a center of one of said track halves.

6. The roundabout of claim 5 wherein said means for connecting either said track halves or said frameworks is an inner pair of pivotal hinges spaced apart from one another and being attached to and spanning between said bars of said frameworks so as to pivotally connect said track halves together via said framewords for pivotal movement about a longitudinal axis defined by said inner pair of hinges.

7. The roundabout of claim 6 wherein said pivotal hinges of said inner pair are spaced apart from one another on opposite sides of said center point of said track.

8. The roundabout of claim 1 wherein each of said riding devices includes:

a flat vertical plate depicting an object;

a seat and a pair of handles mounted on said plate;

a pair of brackets attached to and extending below said plate;

a pair of front and rear wheels arranged in spaced tandem relation to each other and aligned along an circular path corresponding to said circular track, said wheels being rotatably mounted to lower ends of said brackets; and a pair of pedals attached to and projecting from opposite sides of said front wheel.

9. The roundabout of claim 1 wherein said lower portion of said revolving mechanism includes:

a lower runner disposable below adjacent portions of said frameworks with said track halves in a coplanar relation and said platform in said deployed condition; and an elongated cylindrical vertical shaft rigidly attached to and extending upwardly from said lower runner above said frameworks.

10. The roundabout of claim 9 wherein said lower runner includes:

an elongated flat narrow bottom plate disposable below said frameworks; and an upright flat plate fixed along a longitudinal centerline of and extending upwardly from said bottom plate and between said frameworks, said vertical shaft being rigidly attached to and extending upwardly from said upright flat plate of said runner.

11. The roundabout of claim 9 wherein said upper portion of said revolving mechanism includes:

a coupler having a central bore for slidably fitting over said vertical shaft of said lower member of said revolving mechanism such that said coupler is rotatable on said vertical shaft; and an elongated lock structure separate from said coupler and having a central aperture for slidably fitting over said vertical shaft of said lower member below said coupler, said lock structure extending transversely to said vertical shaft and movable toward and away from said lower runner between an upper releasing position wherein said runner can be installed and removed from between and below said frameworks and a lower locking position wherein said lock structure and said runner can be respectively disposed in a clamping relation above and below said adjacent portions of said frameworks with said track halves in said coplanar relation and said platform in said deployed condition.

12. The roundabout of claim 11 wherein said upper portion also includes:

a collar attached on said vertical shaft and being spaced above said coupler; and a coil spring disposed about said vertical shaft said between said collar and said coupler for biasing said coupler and said lock structure therewith toward said lower locking position for retaining said track halves in said coplanar relation and sais platform at said deployed position.

13. The roundabout of claim 9 wherein said upper member of said revolving mechanism also includes:

a coupler having a central bore for slidably fitting over said vertical shaft of said lower portion of said revolving mechanism such that said coupler is rotatable on said vertical shaft; and a plurality of circumferentially spaced pairs of ears attached to and projecting outwardly from said rotatable and slidable coupler.

14. The roundabout of claim 13 wherein said interconnecting members include a plurality of elongated arms each extending between and connected at opposite ends with one of said pairs of ears on the coupler and one of said riding devices.

15. The roundabout of claim 14 wherein said interconnecting members also include a plurality of connector tubes each attached on one of said riding cycles and receiving and connected with one of said opposite ends of said elongated arms.

16. The roundabout of claim 14 wherein said interconnecting members also include a plurality of flexible link chains for interconnecting adjacent ones of said arms to one another.

17. A portable rider-propelled roundabout, comprising:

(a) a platform including a generally circular track defining a central point and being formed by a pair of generally semi-circular halves, said platform also including a pair of reinforcing frameworks each extending between and rigidly connected with spaced portions of one of said track halves, said platform further including outer and inner pairs of spaced hinges respectfully pivotally connecting said track halves to one another and said frameworks to one another so as to permit converting of said platform between a transport condition in which said track halves can be disposed in a side-by-side folded relation to one another and a deployed condition in which said track halves are disposed in an unfolded coplanar relation with one another;

(b) a plurality of pedal-propelled riding cycles, each including a flat vertical plate depicting a figure of a character, a seat, a pair of handles mounted on said plate, a pair of front and rear wheels mounted below said plate and arranged in spaced apart tandem relation to each other and aligned along an circular path concentric with said circular track, and a pair of pedals attached to and project from opposite sides of said front wheel; and (c) a revolving mechanism for supporting said riding cycles upright on said circular track for undergoing revolving movement therealong about said center point of said circular track, said revolving mechanism including a lower member mountable in a stationary relation on said frameworks of said platform and a symmetrical relation about said center point when said platform is in said deployed condition, an upper member mountable on said lower member in a rotatable relation therewith about said center point of said track, and a plurality of members extending between and interconnecting said upper member and said riding cycles for supporting said riding cycles upright on said track of said platform for said revolving movement therealong about said center point of said track;

(d) said upper member including an elongated lock structure movable toward and away from said lower member between an upper releasing position wherein said lower member can be installed and removed from between and below said frameworks and a lower locking position wherein said lower member and said lock structure of said upper members can be respectively disposed in a clamping relation above and below adjacent portions of said frameworks with said track halves disposed in said coplanar relation and said platform in said deployed condition.

18. The roundabout of claim 17 wherein said lower member of said revolving mechanism includes:

a lower runner disposable below adjacent portions of said frameworks with said track halves in said coplanar relation and said platform in said deployed condition; and an elongated cylindrical vertical shaft rigidly attached to and extending upwardly from said lower runner above said frameworks.

19. The roundabout of claim 18 wherein said upper member of said revolving mechanism includes:

a coupler having a central bore for slidably fitting over said vertical shaft of said lower member of said revolving mechanism such that said coupler is rotatable on said vertical shaft;

said elongated lock structure being separate from said coupler and having a central aperture for slidably fitting over said vertical shaft of said lower member below said coupler, said lock structure extending transversely to said vertical shaft and movable toward and away from said lower runner between an upper releasing position wherein said runner can be installed and removed from between and below said frameworks and a lower locking position wherein said lock structure and said runner can be respectively disposed in a clamping relation above and below said adjacent portions of said frameworks with said track halves in said coplanar relation and said platform in said deployed condition.

20. The roundabout of claim 19 wherein said upper member also includes:

a collar attached on said vertical shaft and being spaced above said coupler; and a coil spring disposed about said vertical shaft said between said collar and said coupler for biasing said coupler and said lock structure therewith toward said lower locking position for retaining said track halves in said coplanar relation and sais platform at said deployed position.

* * * * *